United States Patent [19]

Considine

[11] Patent Number: 4,911,083

[45] Date of Patent: Mar. 27, 1990

[54] MECHANICS' TOOL TRAY

[76] Inventor: Thomas D. Considine, 7140 Ledgewood, Fenton, Mich. 48430

[21] Appl. No.: 254,711

[22] Filed: Oct. 7, 1988

[51] Int. Cl.[4] ..... A47B 23/00

[52] U.S. Cl. ..... 108/44; 108/25; 211/70.6; 211/60.1; 206/327; 206/562

[58] Field of Search ..... 108/25, 26, 44, 45; 224/273, 311; 280/32.6, 47.34; 248/503; 211/70.6, 126, 60.1; 206/211, 327, 562, 564

[56] References Cited

U.S. PATENT DOCUMENTS

| | | | |
|---|---|---|---|
| D. 235,850 | 7/1975 | Diforte, Jr. | D8/231 |
| 2,662,382 | 12/1953 | Potchen | 211/126 |
| 2,805,778 | 9/1957 | Yordi | 108/44 |
| 2,818,316 | 12/1957 | D'Andrade | 108/44 |
| 2,901,303 | 8/1959 | Anderson | 108/44 |
| 2,922,684 | 1/1960 | Miller et al. | 108/44 |
| 2,942,920 | 6/1960 | French | 108/44 |
| 2,958,566 | 11/1960 | Buck | 108/44 |
| 2,962,333 | 11/1960 | Policastro | 108/44 |
| 3,023,063 | 2/1962 | Hansen | 108/44 |
| 3,794,181 | 2/1974 | Canham | 211/65 |
| 3,922,973 | 12/1975 | Sturgeon | 108/44 |
| 4,184,592 | 1/1980 | Howard, Jr. | 206/327 |
| 4,500,059 | 2/1985 | Papizan | 211/88 |

*Primary Examiner*—Kenneth J. Dorner
*Assistant Examiner*—Brian K. Green
*Attorney, Agent, or Firm*—Brooks & Kushman

[57] ABSTRACT

An accessory tray (10) for use in the engine compartment of a vehicle. The tray (10) includes an aperture (24) for receiving a mounting stud (14) which extends upwardly from a carburetor (12). A pair of flanges (36) extends outwardly from the sides of the tray, and each flange (36) has a plurality of holes (38) therethrough for receiving spark plugs or tools. Securable to the underside of the accessory tray (10) is at least one inverted cup-shaped retainer (40), the retainer being selected so as to circumscribe the upper portion of the carburetor (12) for supporting the accessory tray (10).

15 Claims, 3 Drawing Sheets

MECHANICS' TOOL TRAY

TECHNICAL FIELD

This invention relates to improvements in tool trays which are removably attached to a motor vehicle, and more particularly to a new and improved tray which is usable atop a carburetor of an engine.

BACKGROUND ART

It is well known in the art to provide a mechanic's tool carrier in the form of a sliding cart for supporting the back of a mechanic as he slides beneath the engine compartment of a motor vehicle to enable him to access and repair various vehicle components from below. However, when working on various components of the engine compartment from above, it is necessary for the mechanic to lean over the radiator or fenders of the vehicle in order to work on various engine components. This becomes inconvenient and uncomfortable when working on hard-to-reach components of an engine, such as the back side of the carburetor, a distributor, intake manifold, PCV valve, windshield wiper, or heater motor, etc.

A continuing difficulty is that of finding a suitable interim storage location for mechanic's tools, used parts and accessories removed from the vehicle, and new parts and accessories to be installed in the vehicle. Ideally, the interim storage location should be readily accessible, centrally located, yet retain the tools and accessories without allowing them to be spilled or dislodged into the numerous interstices which reside under the hood of the vehicle in the engine compartment.

Another problem which has hitherto been unsolved is that of organizing the tools and accessories while, at the same time, storing them. In practice, it has been found that when a miscellany of tools, parts, and accessories become intermixed within a container, the smaller components tend to settle into the more difficult-to-reach crevices of the container, so that such small tools and accessories become difficult to see and hard to reach, particularly one-handedly.

Another problem remaining unsolved by previous approaches arises from the difficulty of mounting an accessory tray atop differently sized carburetors which are found to be associated with various engines. In practice, the diameter of carburetor throat varies from one carburetor to another. To accommodate the different sizes of carburetors upon which an accessory tray may be mounted, it would be helpful to have an accessory tray which has interchangeable bases with different diameters. This feature would enable one to select a given base according to its diameter, so as to enable the base to circumscribe the throat of the particular carburetor upon which work is being performed.

Accordingly, it is an object of the accessory tray of the present invention to provide a stable receptacle in which tools, parts, and accessories can readily be stored and organized in a convenient location in the working area proximate the engine compartment of a vehicle.

SUMMARY OF THE INVENTION

To address these and related problems, an accessory tray according to the present invention is used proximate the engine compartment of a vehicle. As is well known, the engine compartment includes a carburetor and a mounting stud extending upwardly from the carburetor upon which the accessory tray of the present invention is mounted.

The accessory tray includes at least one inverted cup-shaped retainer which is securable to the underside of a central panel of the accessory tray. In storage, the inverted cup-shaped retainers can be nested within each other and are securable by means for securing the retainers to the underside of the central panel of the accessory tray. In use, one of the inverted cup-shaped retainers is selected according to the diameter of the particular carburetor upon which the accessory tray is to be mounted. The unused inverted cup-shaped retainer, having been detached from the underside of the accessory tray, is temporarily set aside.

In practice the means for securing the central panel to the mounting stud of the carburetor includes a nut and bolt, the nu and bolt defining a longtitudinal bore therethrough. The bore receives the mounting stud, and then the inverted cup-shaped retainer is placed atop the mounting stud, the stud extending upwardly through an orifice in the base of the inverted cup-shaped retainer.

The central panel of the accessory tray includes an aperture into which is inserted the mounting stud of the carburetor. Finally, a nut portion of the means for securing threadingly engages the mounting stud. When the nut is tightened, the inverted cup-shaped retainer and the central panel of the accessory tray are then firmly secured atop the carburetor of the engine so as to provide a stable, working receptacle for accommodating and organizing various parts, tools, and accessories.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
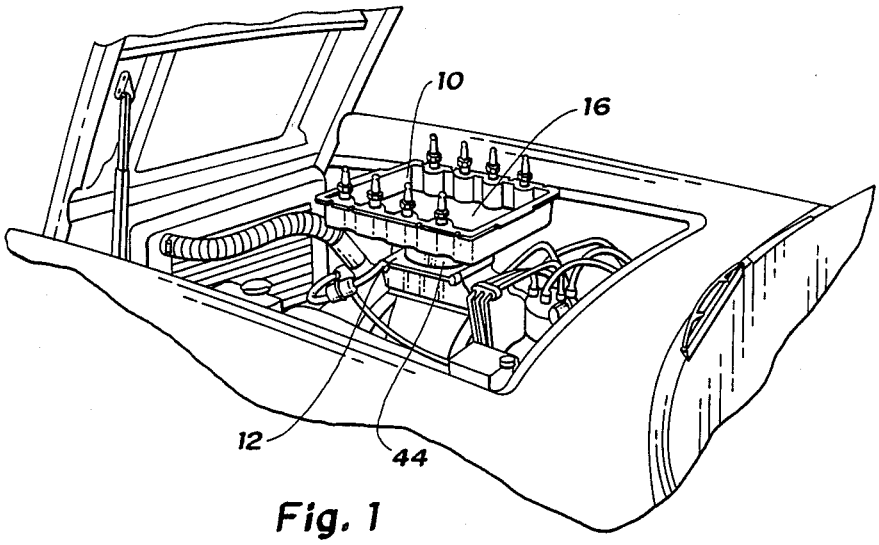
FIG. 1 is a perspective, environmental view including an accessory tray constructed in accordance with the present invention.

Turning first to FIG. 1, there is illustrated an accessory tray 10 located in the engine compartment of a vehicle. In its environmental context, the accessory tray 10 is securable atop a carburetor 12 which has a mounting stud 14 extending upwardly from the carburetor 12. As is well known, a conventional air filter is often secured to the mounting stud 14. In FIG. 1, however, the air filter has been removed from the carburetor 12 before installation of the accessory tray 10.

With primary reference to FIGS. 2–5, the accessory tray 10 includes a central panel 16. The central panel 16 has side portions 18, 18' including alternating concave and convex portions and end portions 20, 20', together with a mid portion 22 located therebetween. Included in the mid portion 22 is an aperture 24 for receiving the mounting stud 14 of the carburetor 12. To secure the mid portion 22 of the central panel 16 to the mounting stud 14, means for securing, such as a nut 56 and a bolt 58 are provided.

A pair of side panels 28 28' extend upwardly from the side portions 18, 18' of the central panel 16. Included in each side panel 28, 28' is an upper side edge 30, 30'. Correspondingly, a pair of end panels 32, 32' extend upwardly from the end portions 20, 20' of the central panel 16. Each end panel 32, 32' includes an upper end edge 34, 34'.

Extending outwardly from the upper side edges 30, 30' of the side panels 28, 28' is a pair of flanges 36, 36'. To accommodate such items as spark plugs and tools, each flange 36, 36' has a plurality of holes 38 therethrough.

Figure 5:
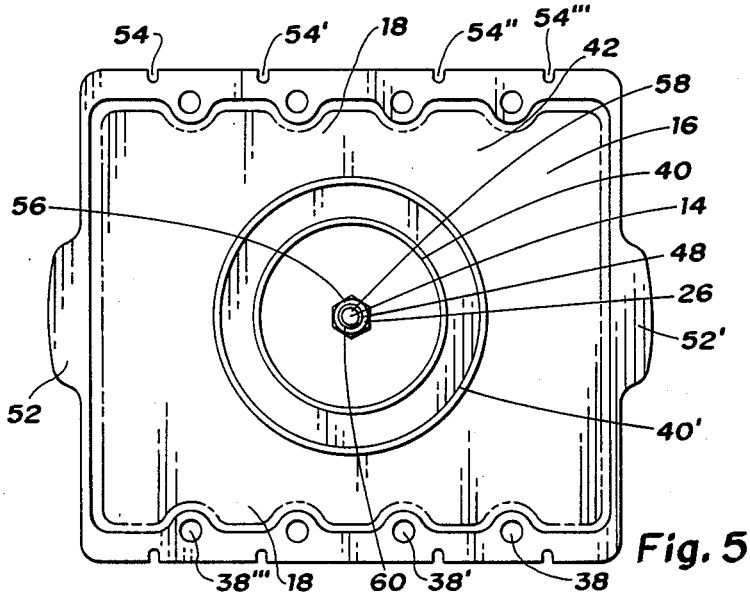
FIG. 5 is a bottom view of the accessory tray including inverted cup-shaped retainers constructed in accordance with the present invention.

Continuing with primary reference to FIG. 5, the accessory tray 10 includes at least one inverted cup-shaped retainer 40, 40' which is securable to the underside 42 of the central panel 16. One of the cup-shaped retainers 40, 40' circumscribes the upper portion 44 of the carburetor. In use, each of the inverted cup-shaped retainers 40, 40' is detachable from the underside 42 of the accessory tray 10. Each cup-shaped retainer 40 has a base 46 including a central orifice 48 through which the mounting stud 14 o the carburetor 12 can pass.

Figure 4:
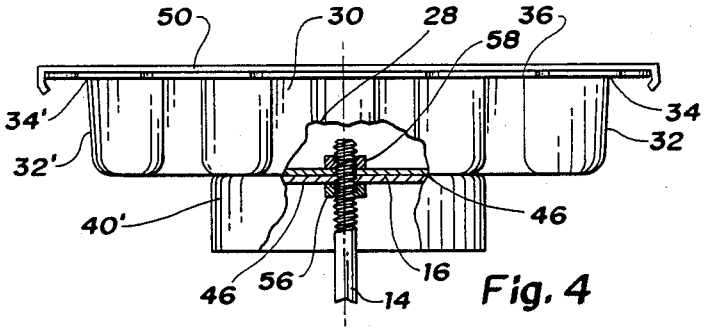
FIG. 4 is a partially sectioned, side view of the accessory tray constructed in accordance with the present invention.

As best shown in FIG. 4, the accessory tray 10 of the present invention further includes a lid 50 which can be secured atop the upper edges 34, 34' of said end panels 32, 32'.

Turning once again to FIG. 2, there is shown a handle 52, 52' which extends outwardly from the upper end edges 34, 34' of the end panels 32, 32'. In use, the handle 52, 52' is grasped while securing, removing, and transporting the accessory tray 10 by hand.

Figure 2:
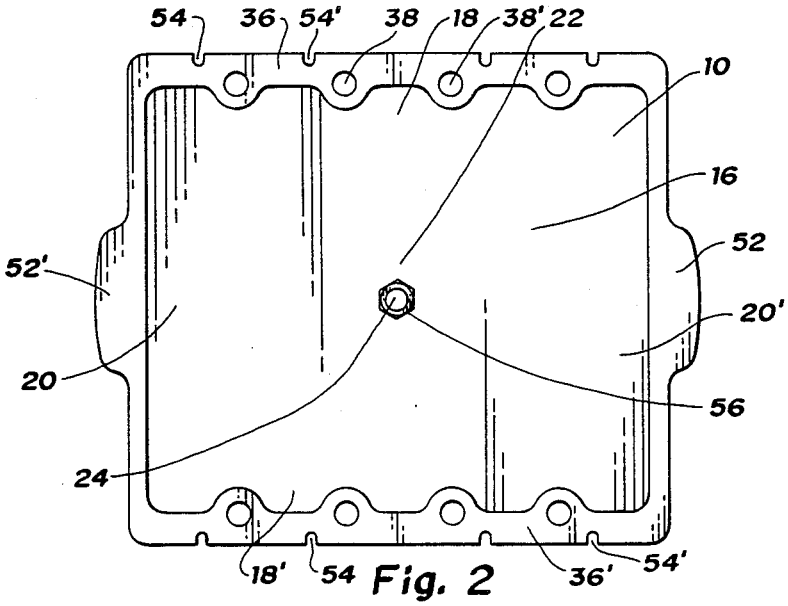
FIG. 2 is a plan view of the accessory tray constructed in accordance with the present invention.
Figure 3:
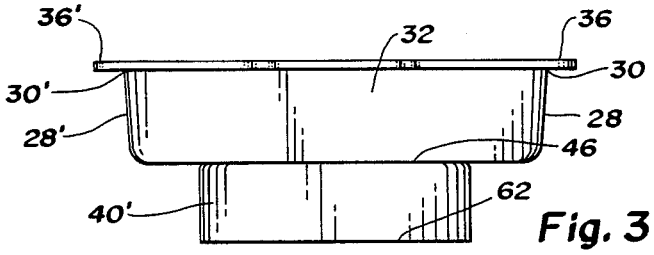
FIG. 3 is an end view of the accessory tray constructed in accordance with the present invention.
Figure 6:
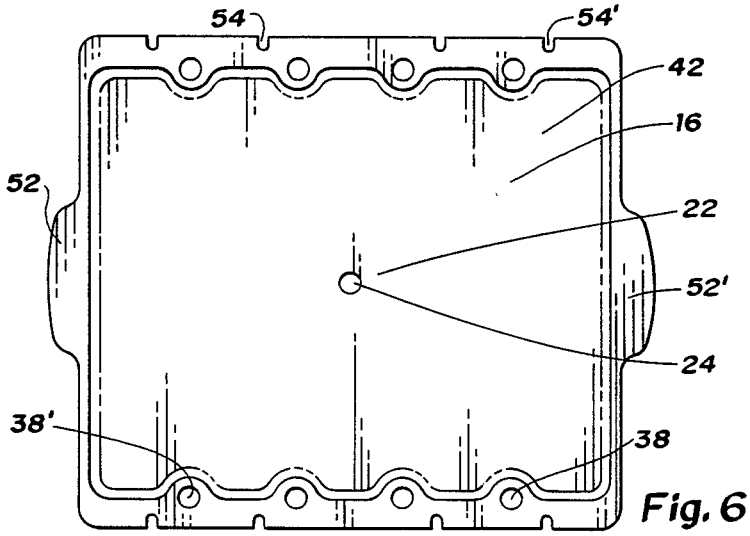
FIG. 6 is a view of the underside of the accessory tray constructed in accordance with the present invention, without the inverted cup-shaped retainers.
Figure 7:
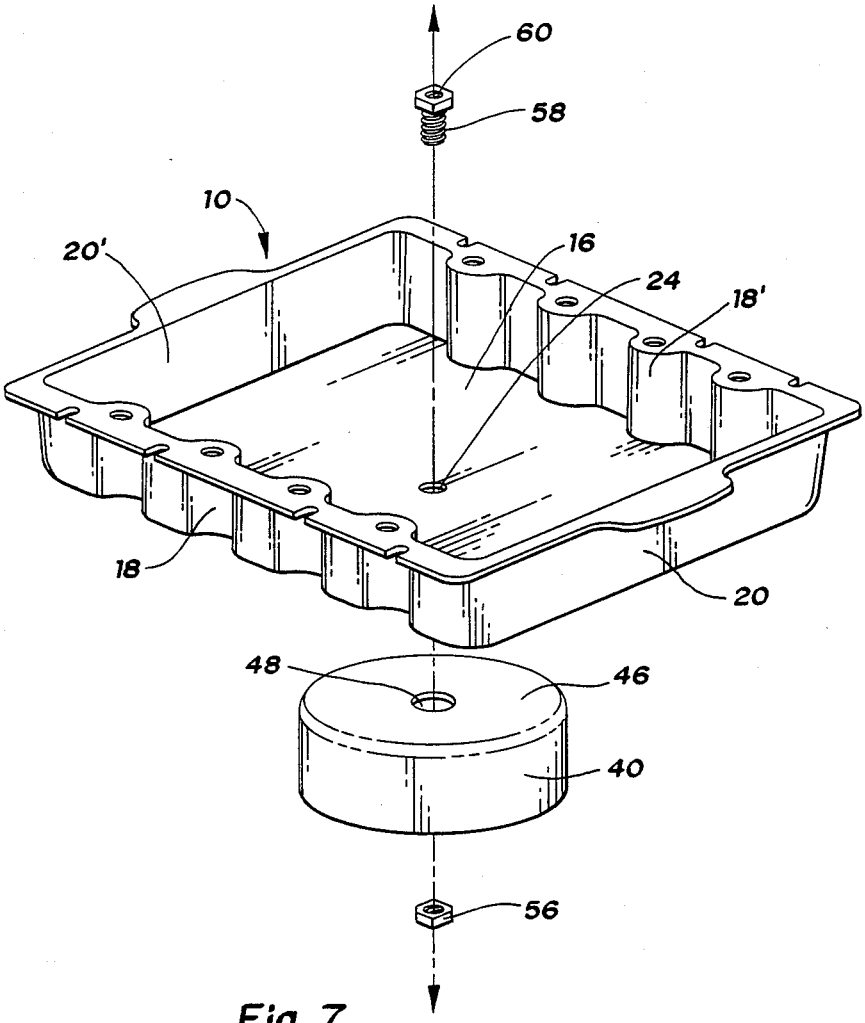
FIG. 7 is an exploded perspective view of the accessory tray illustrating a method of assembly thereof.

Continuing with primary reference to FIGS. 2 and 5–6, there is shown an embodiment of the accessory tray 10 including in each flange 36, 36' four holes 38, 38', 38'', 38''', each of which being adaptable to receive a spark plug, tool, or other accessory. The pair of flanges 36, 36' also includes a plurality of notches 54, 54', 54'', 54''' extending upwardly therethrough, each notch being adapted to receive a spark plug wire.

The spark plugs are received by the concave portions of the side panels 18, 18'.

Turning now to FIGS. 2 and 5, the accessory tray 10 of the present invention includes means for securing 26 which comprise a nut 56 and a bolt 58, or the like. Extending longtitudinally through the bolt 58 is a bore 60 for receiving the mounting stud 14 of the carburetor 12.

The accessory tray 10, depicted in top view in FIG. 2 and bottom view in FIG. 5, includes a first inverted cup-shaped retainer 40 having a first diameter and a second inverted cup-shaped retainer 40' having a second diameter which is larger than the first diameter. This enables the first retainer 40 to be nested within the second retainer 40' when the accessory tray 10 is stored during periods of non-use. To afford packing and storage economies, the first inverted cup-shaped retainer 40 is disposed concentrically with respect to the second inverted cup-shaped retainer 40'. As shown in FIG. 5, each inverted cup-shaped retainer 40, 40' is securable to the underside 42 of the central panel 16 by the means for securing 26. Each inverted up-shaped retainer 40, 40' has an open end 62 which faces away from the central panel 16. In use, the size of inverted cup-shaped retainer 40 is selected so as to circumscribe the upper portion 44 of the particular carburetor 12 which is found in the engine compartment of the vehicle.

It will thus be apparent that the accessory tray 10 of the present invention is universal in the sense that only one accessory tray 10 need be used with any one selected from a nest of interchangeable, inverted cup-shaped retainers, the retainer being selected according to the diameter of the particular carburetor throat upon which work is being performed.

In use, the aperture 24 in the central panel 16 is concentric with the orifice 48 of the inverted cup-shaped retainers 40, 40, and the mounting stud 14 of the carburetor 12. The accessory tray 10 is secured atop the carburetor 12 by passing the mounting stud 14 through the bore 60 of the bolt 58 or through the nut 56 (whichever is desired), with the nut 56 or head of the bolt 58 being proximate the underside 42 of the central panel 16. Next, a cup-shaped retainer 40 is selected according to its diameter so as to circumscribe the upper portion 44 of the carburetor 12. The inverted cup-shaped retainer 40 selected is then placed over the mounting stud 14 so that the orifice 48 and the base 46 of the cup-shaped retainer 40 receives the mounting stud 14. The central panel 16 of the accessory tray 10 is then deployed so that the aperture 24 receives the mounting stud 14, and either the nut 56 or the bolt 58 is then threadingly engage. It should be understood that the invention as taught by the present disclosure can be practiced either by first inserting the bolt 58 over the mounting stud 14 or by first inserting the nut 56 over the mounting stud 14. If the bolt 58 is selected first, then it will lie on the underside of the central panel 16, and the inverted cup-shaped retainer 40 be secured to the central panel 16 by threadingly engaging the nut 56 from the top side of the central panel 16. If however, the nut 56 is first selected to lie below the central panel 16, then the head of the bolt 58 will lie above the central panel 16. In either case, upon tightening the nut 56 relative to the bolt 58, the central panel 16 of the accessory tray 10 is securely affixed to the selected inverted cup-shaped retainer 40, ready for mounting atop the carburetor 12 in the engine compartment of the vehicle.

To complete the assembly, if desired, a wing nut 64, similar to the type of wing nut which secures an air filter (not shown) to the mounting stud 14, can be screwed onto the threaded top of the mounting stud 14 which extends above the central panel 16. In this way, the accessory tray 10 is securely mounted atop the carburetor 12.

In accordance with the present invention, there has been disclosed an accessory tray 10 having interchangeable inverted cup-shaped retainers 40, 40', from which can be selected a retainer which is appropriate to the size of the carburetor 12 in the engine compartment in which work is being done. By following the teaching of the invention disclosed and claimed, only one accessory tray 10 is needed to work in the engine compartments of different vehicles having different engine sizes. The holes 38 afford a ready, convenient receptacle for spark plugs, tools, accessories, and the like. Added convenience is afforded by the handles 52, 52' by which the accessory tray 10 can be manipulated. Finally, if it is desired to use the accessory tray 10 as an interim storage location for tools, accessories, and the like between their periods of use, the convenience of having a lid 50 is readily apparent.

While the best mode for carrying out the invention has been described in detail, those familiar with the art to which the invention relates will recognize alternative ways of practicing the invention as defined by the following claims.

What is claimed:

1. An accessory tray for retaining tools and parts, the accessory tray being for use proximate an engine compartment of a vehicle, the accessory tray comprising:

a central panel having side and end portions and a mid portion located therebetween, said mid portion including an aperture for receiving a mounting stud of a carburetor, means for securing said mid portion of said central panel to the mounting stud of said carburetor so that the accessory tray is firmly held thereabove for ease of use proximate a central area of the engine compartment and for ease of access to the tray proximate an engine in said engine compartment, a pair of side panels extending upwardly from said side portions of said central panel, each side panel including an upper side edge, a pair of end panels extending upwardly from said end portions of said central panel, each end panel including an upper end edge, a pair of side flanges extending outwardly from said upper side edges of said side panels , each flange having a plurality of holes therethrough; and a plurality of notches extending through said flanges.

2. The accessory tray of claim 1, further including at least one inverted cup-shaped retainer which is removably securable to the underside of said central panel, said at least one inverted cup-shaped retainer being adapted to circumscribe the upper portion of the carburetor, and said at least one inverted cup-shaped retainer having a base, said base including a central orifice through which the mounting stud of the carburetor can pass.

3. The accessory tray of claim 1, further including a lid having a pair of end flanges adapted to engage said upper edge ends of said end panels for securement of said lid so that said lid can be secured atop said upper edges of said panels for secure storage of tools and parts within the tray.

4. The accessory tray of claim 1, each of said upper end edges of said pair of end panels having a handle formed of one piece therewith and extending outwardly therefrom.

5. The accessory tray of claim 1, wherein said plurality of holes comprises four holes, each of which holes being sized to receive a spark plug, said side flanges lying on opposite sides of the accessory tray so that spark plugs associated with different flanges are separated by said central panel.

6. The accessory tray of claim 1, wherein said plurality of holes in said pair of flanges comprises four holes, each hole being adaptable to receive a spark plug, said flanges lying on opposite sides of the accessory tray so that spark plugs associated with different flanges are separated by said central panel, each flange in said pair of flanges including a plurality of notches, each notch being adapted to receive a spark plug wire so that spark plug wires associated with different flanges are separated by said central panel for ease of access to a workplace.

7. The accessory tray of claim 1, wherein said means for securing includes a nut and a bolt, said bolt having a longitudinally extending bore for receiving the mounting stud of the carburetor.

8. The accessory tray of claim 2, wherein said at least one inverted cup-shaped retainer includes a pair of inverted cup-shaped retainers, said pair of inverted cup-shaped retainers comprising a first retainer having a first diameter, and a second retainer having a second diameter which is larger than said first diameter.

9. The accessory tray of claim 2, wherein said at least one inverted cup-shaped retainer is disposed concentrically with respect to said aperture of said central panel.

10. The accessory tray of claim 2, wherein each inverted cup-shaped retainer has an open end which faces away from said central panel.

11. The accessory tray of claim 3, wherein each of said inverted cup-shaped retainers is adaptable to circumscribe the upper portion of differently sized carburetors.

12. The accessory tray of claim 1, wherein said means for securing said mid portion of said central panel to the mounting stud includes a nut which is threadingly engaged by the mounting stud so that the accessory tray is firmly secured atop the carburetor by the mounting stud.

13. An accessory tray for retaining tools and parts, the accessory tray being for use proximate a mounting stud of a carburetor in an engine compartment of a vehicle, the mounting stud extending upwardly from the carburetor, the accessory tray comprising:

a central panel having side and end portions and a mid portion located therebetween, said mid portion including an aperture for receiving the mounting stud of the carburetor, means for securing said mid portion of said central panel to the mounting stud of said carburetor so that the accessory tray is firmly held thereabove for ease of fuse proximate a central area of the engine compartment and for ease of access to the tray proximate an engine in said engine compartment, a pair of side panels extending upwardly from said side portions of said central panel, each side panel including an upper side edge, a pair of end panels extending upwardly from said end portions of said central panel, each end panel including an upper end edge, a pair of side flanges extending outwardly from said upper side edges of said side panels, each flange having a plurality of holes therethrough, wherein said flanges have a plurality of notches extending upwardly therethrough.

14. The accessory try of claim 13, wherein said plurality of notches comprise four notches, each of which notches being adapted to receive a spark plug wire, said flanges lying on opposite sides of the accessory tray so that spark plug wires associated with different flanges are separated by said central panel for ease of access to a workplace.

15. A rectangular accessory tray having a central portion, a pair of side panels extending upwardly from the central portion, and a pair of end panels extending upwardly from the central portion, said tray having an aperture for receiving therethrough a mounting stud of a carburetor, a pair of flanges, each one of the pair of flanges extending outwardly from an upper edge of the associated side panel, each of said flanges having a plurality of holes and notches extending therethrough, and an inverted cup-shaped retainer which is securable to the underside of said tray, said inverted cup-shaped retainer being adapted to circumscribe the carburetor and having a central aperture through which the mounting stud of a carburetor can pass.

* * * * *